United States Patent [19]

Carlson

[11] 4,295,316

[45] Oct. 20, 1981

[54] NESTABLE BUILDING WALL PANEL

[75] Inventor: Lawrence E. Carlson, Lower Burrell, Pa.

[73] Assignee: Aluminum Company of America, Pittsburgh, Pa.

[21] Appl. No.: 792,782

[22] Filed: May 2, 1977

[51] Int. Cl.[3] ..... E04C 1/10

[52] U.S. Cl. ..... 52/588; 52/539; 52/530

[58] Field of Search ..... 52/588, 537, 544, 539, 52/529–532

[56] References Cited

U.S. PATENT DOCUMENTS

| | | | |
|---|---|---|---|
| 2,880,589 | 4/1959 | Wilson | 52/588 |
| 3,234,697 | 2/1966 | Toti | 52/588 |
| 3,315,429 | 4/1967 | Swanson | 52/588 |
| 3,884,328 | 5/1975 | Williams | 52/588 |

FOREIGN PATENT DOCUMENTS

| | | | |
|---|---|---|---|
| 529025 | 6/1954 | Belgium | 52/588 |
| 835016 | 2/1970 | Canada | 52/588 |

*Primary Examiner*—Price C. Faw, Jr.
*Assistant Examiner*—Henry E. Raduazo
*Attorney, Agent, or Firm*—Patrick J. Viccaro

[57] ABSTRACT

A contoured building panel is provided which is adapted to be secured to a building structure by concealed fasteners. The panel has improved nestability with other like panels in a vertical stack for storage and shipment such that the stack of nested panels has a relatively small stack height. The panel has a body portion having at least one longitudinally extending channel with opposed substantially continuously diverging sidewalls and edge structures on both sides of the channel mouth projecting laterally outwardly from the body portion of each panel. One edge structure has a reverse bend therein forming a laterally open groove for receiving a portion of the opposite edge structure of an adjacent panel and a fastening edge portion for securing the panel to a building structure by fastening means which in an assembled condition underlies a portion of the adjacent panel near the opposite lateral edge. Both compression and tension locking building panels are provided.

1 Claim, 14 Drawing Figures

NESTABLE BUILDING WALL PANEL

BACKGROUND OF THE INVENTION

This invention relates to a building panel for roofing, siding, walls and the like, adapted to be attached to building structures by concealed fasteners. More particularly, the invention relates to a contoured building panel having locking edge structures and improved nestability for storage and shipment.

The building industry uses sheet and extruded panels for roofing, siding, walls and the like to provide quickly and easily assembled building structures. In the prior art, building panels appear in a variety of configurations and are provided with different types of fastening means for securing the panels to a building structure and for joining adjacent panels at their edges. Use of concealed fasteners has its advantages in that the aesthetic appearance of the assembled building panels may be more pleasing if the fastening screws, clips, nails and the like are not visible. Furthermore, when the panels are exposed to the weather, as on the outside walls of a building, the use of external fasteners is disadvantageous in that the fasteners and any holes in the panel for the fasteners are more likely to be the subject of corrosion and a source for leakage. It is also desirable to provide edge structures which, when joined with edges of adjacent panels, form a liquid-tight joint. U.S. Pat. No. 3,363,380, issued Jan. 16, 1968, discloses a generally wedge-shaped shingle which is secured to a structure by concealed nails. Each shingle has cooperating edge structures with one edge being substantially folded over itself to be adapted to receive the opposite edge structure of an adjacent shingle. Nails secure the shingle by the edge structure which is substantially folded over itself and the nails are concealed from view as they underlie an opposite end portion of the adjacent shingle. A sheathing member is disclosed in U.S. Pat. No. 3,495,363, issued Feb. 17, 1970, having an unexposed fastening means which underlies an end portion of an adjacent sheathing member in an assembled condition. The members are joined at their edge structures by an inwardly hooking surface of one panel received by a cooperating groove on the opposite edge structure of an adjacent panel. Still another form of a contoured building panel having a concealed fastener means, cooperating tongue and groove type end structures and a backing board is disclosed in U.S. Pat. No. 3,886,704, issued June 3, 1975.

A disadvantage of the concealed fastener building panels of the prior art is that they are not easily nestable, if at all, in stacks for shipment and storage. Efficient stacking of such panels is hindered by the configuration of both the contoured body portion and the panel edge structures. In the building industry, the cost of shipment and storage of building panels depends, in part, upon the volume of space occupied which, in turn, is determined by the number of panels that can be stacked per unit volume. Panels that are nestable in a stack reduce such costs by providing more stacked panels per unit volume. One manner of dealing with the nestability problem of stacked panels is shown in U.S. Pat. No. 3,253,376, issued May 31, 1966. There a contoured building panel having a pair of opposed hook-shaped portions at its edges is shown stacked by alternately inverting every other panel in the stack of panels.

The prior art, however, still does not provide a concealed fastener, contoured building panel that can be efficiently nested with other like panels in a vertical stack without alternate stacking. Such a nestable building panel would minimize the shipment and storage costs by permitting vertical stacking of more building panels in a given volume of space.

SUMMARY OF THE INVENTION

In accordance with the present invention, a building panel is provided which can be secured to a building structure by concealed fasteners and which has an improved nestability with other like panels in a vertical stack. The panel comprises a body portion having at least one longitudinally extended channel having opposed substantially diverging sidewalls and mating lateral edge structures along opposite sides of the panel for engaging an opposite edge structure of an adjacent panel. The edge structures project substantially laterally outwardly from the body portion of the panel, with each edge structure having a maximum extent measured normal to the general plane of the panel of no more than 25% of the channel extent measured in the same direction. The maximum extent of the edge structures determines the stack height between nested panels. At least one edge structure has a reverse bend therein forming a laterally open groove for receiving a portion of the opposite edge structure of an adjacent panel. The panels are secured to a building structure by concealed fastening means on a fastening edge portion of the edge structure having a reverse bend and disposed laterally outwardly of the laterally open groove formed by the reverse bend therein.

An object of the invention is to provide an aesthetically contoured, concealed fastener building panel having improved nestability for vertical stacking for shipment and storage.

Another object of the invention is to provide nestable compression locking building panels and nestable tension locking building panels.

A further object of the invention is to provide a nestable, contoured building panel designed to maximize support and increase bearing areas to minimize marking of the panels due to localized packing stresses on exposed surfaces during stacking for storage and shipment.

DETAILED DESCRIPTION OF THE PREFERRED EMBODIMENTS

Figure 1:
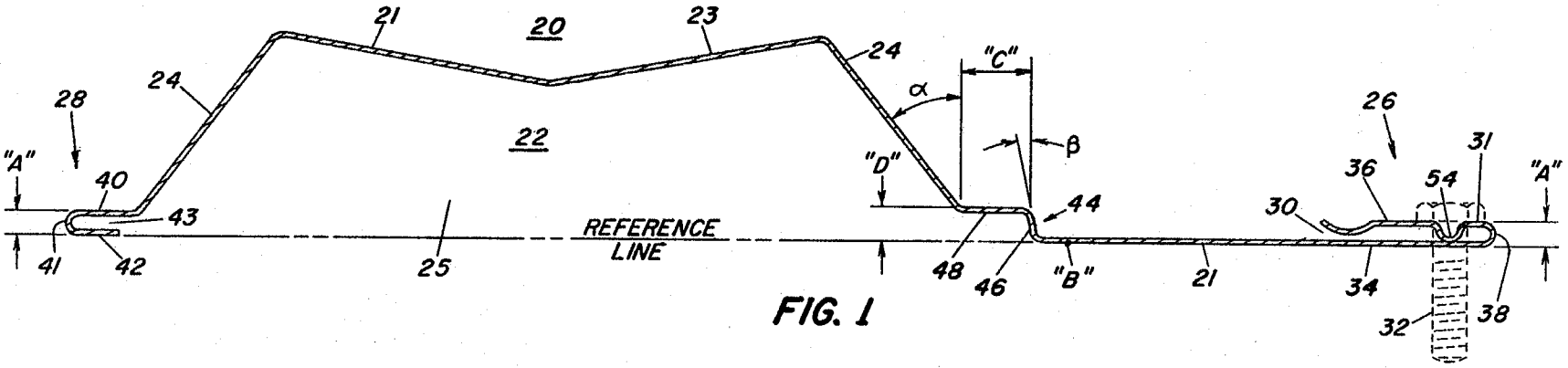
FIGS. 1 to 4 are cross-sectional views of preferred embodiments of a building panel of the present invention.

FIG. 1 illustrates the cross-sectional view of a preferred embodiment of building panel 20 of the present invention. The body portion 21 of building panel 20 includes at least one longitudinally extending channel 22 having opposed diverging sidewalls 24. On the opposite lateral edges of panel 20 are mating edge structures 26 and 28; the first edge structure 26 and the second edge structure 28 both extending or projecting outwardly substantially laterally from opposite sides of the body portion 21 of panel 20. Preferably the edge structures are located along opposite sides of body portion 21 of panel 20 at the periphery of body portion 21 such that no portion of the edge structure projects inwardly and either overlies or underlies the body portion 21 of the building panel 20. First edge structure 26 has a reverse bend therein forming a laterally open groove 30 and has a fastening edge portion 31 disposed laterally outwardly of the open mouth of groove 30 for receiving a fastening means for securing building panel 20 to a wall structure.

For all purposes herein, "outward" and "inward" are used to mean directions, respectively, away from and toward the centerline of the panel in the general plane of the panel; the panel centerline being parallel to the axis of a longitudinal channel in the panel. By "laterally" is meant a direction parallel to the general plane of the panel either outwardly or inwardly with respect to the panel centerline. "Exposed" and "concealed" disposition of panel faces means directions perpendicular to the general plane of the panel which, when secured to a building structure, would expose a face away from the building structure and hide a face on the building structure.

FIG. 1 more particularly illustrates a cross-sectional view of a preferred embodiment of a tension locking building panel 20 of the present invention. Channel 22 of panel 20 has sidewalls 24 diverging from base 23 of the channel to mouth 25 of the channel for permitting channels of stacked panels to nest, and channel 22 may open in the exposed or unexposed (concealed) face of panel 20 when assembled with other like panels on the building structure. Sidewalls 24 of channel 22 must be substantially diverging continuously to permit nesting within the scope of this invention. By substantially diverging continuously it is meant that the sidewalls 24 and all portions of walls of channel 22 extend substantially away from a longitudinal centerline of channel 22 from base 23 to mouth 25 of channel 22 toward the opposite sides of body portion 21 with no wall portion lying in a plane normal to the general plane of panel 20 or laying in a converging plane. If any wall portions of the channel lie in a plane perpendicular to the general plane of the panel, the nestability of the panels to a small or short stack height is impeded. Preferably, the channel is symmetrical about a longitudinally extending centerline of channel 22 with symmetrical diverging sidewalls 24. Panel 20 may be of an elongated configuration with a longitudinally extending channel 22 therein.

Figure 2:
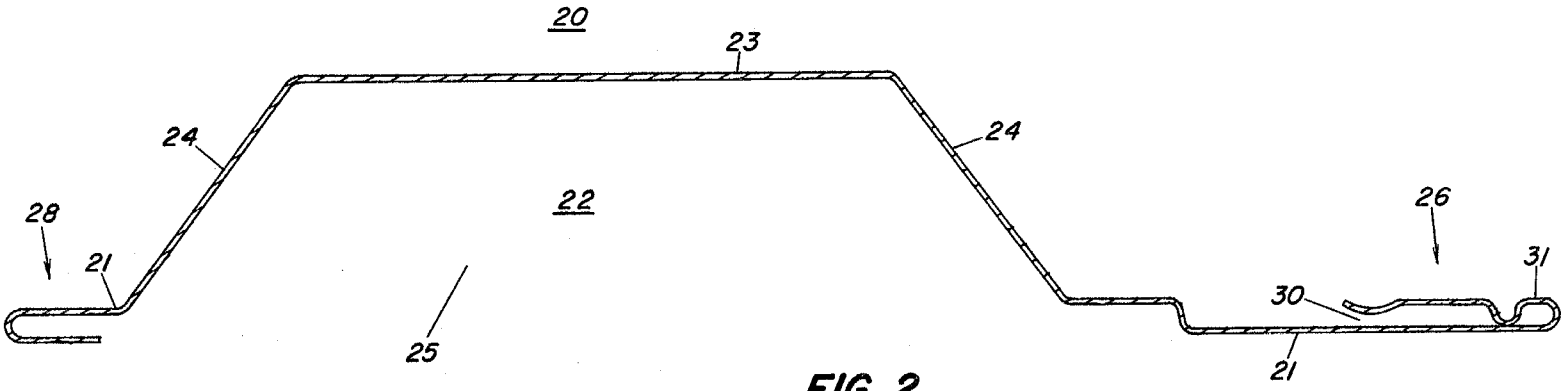
Figure 3:
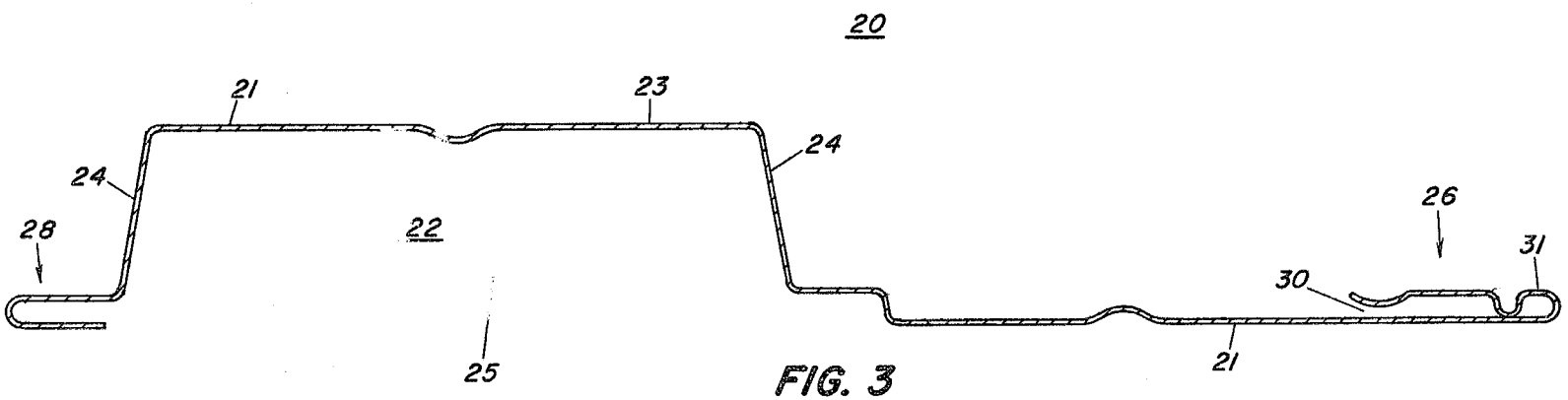
Figure 4:
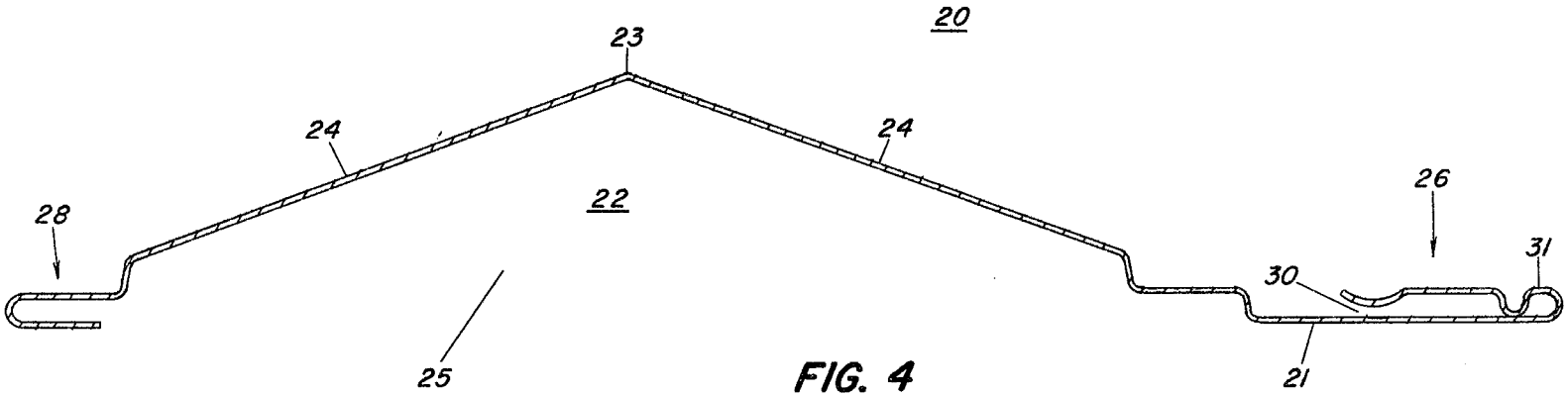

FIGS. 2 to 4 illustrate the cross-sectional views of alternative configurations of channel 22 of building panel 20. Channel 22 may be substantially U-shaped as in FIGS. 2 and 3, or V-shaped as in FIG. 4. For all configurations of channel 22 within the scope of this invention, the walls of channel 22 are generally and substantially diverging.

FIG. 1 further illustrates the generally and substantially diverging sidewalls 24 of channel 22 by angle $\alpha$, which is the angle measured between a sidewall 24 and a plane normal to the general plane of panel 20 and parallel to the longitudinal axis of channel 22. The normal plane is depicted as a vertical line in FIG. 1. For all configurations of channel 22 within the scope of this invention, to provide the desired nestability, angle $\alpha$ must be greater than zero, and should be at least 3 degrees. Preferably, angle $\alpha$ is greater than 5 degrees and ranges from 5 to 80 degrees. When sidewall 24 is not substantially planar, in whole or in part, as shown in FIG. 1, the angle $\alpha$ may be measured from the vertical to a "mean line" through sidewall 24. The mean line is a straight line representing a nonplanar diverging sidewall for purposes of defining the angle $\alpha$.

An optimum angle $\alpha$ can be calculated to provide a building panel with the most efficient nesting and with the greatest amount of bearing areas to maximize supporting surfaces in stacked panels. For equal bearing in a stack, the angle $\alpha$ can be determined from the following formula:

$$\alpha = \sin^{-1}(t/A)$$

where t is the material thickness of the building panel including coatings, patterns and the like; and A is the extent (height) of the larger of edges 26 and 28 measured normal to the general plane of panel 20.

The actual angle $\alpha$ of a building panel of the present invention can be less than the optimum angle $\alpha$ and still provide equal nestability, but less bearing area would result. As angle $\alpha$ becomes even smaller than the optimum angle $\alpha$, both nestability and the amount of bearing areas would be minimized. Such an inefficiency occurs for as the angle $\alpha$ approaches zero degrees, the channel sidewalls 24 are less diverging and approach the plane normal to the general plane of panel 20. Thus, each panel would stack with another like panel with less nesting of the channels. Contact between such panels occurs at the sidewalls 24 near the mouth of the channel of a panel high in the stack and near the bottom wall of the channel adjacent and immediately below in a stack.

Edge structure 26, shown in FIG. 1, includes substantially laterally extending legs, first leg 34 and second leg 36, having a reverse bend 38 therebetween, forming a laterally open groove 30 for receiving the opposite edge structure 28 of an adjacent panel 20. Legs 34 and 36 of edge structure 26 lie in and about a plane substantially parallel to the general plane of panel 20. Groove 30 may be laterally open "inwardly" or "outwardly" and, preferably, lies in the exposed face of a panel when secured to a building structure. Edge structure 26, as shown in FIG. 1, with groove 30 laterally open inwardly in the direction toward body portion 21 of panel 20, receives a terminal edge portion of opposite edge structure 28 for tension locking panels 20 in an assembled condition on a building structure. As shown in FIGS. 8 to 11, groove 30 opens laterally outwardly for compression locking panels. In both tension and compression panel configurations, the edge structures 26 and 28 project outwardly and substantially laterally from the channel mouth 25.

The edge structure 26, having the laterally open groove 30, also includes a fastening edge portion for receiving a fastening means to secure building panel 20 to a building structure for assembly with other like panels. FIG. 1 shows a fastening means 32 (in dotted lines), which may be a screw, clip, nail or the like, laterally outwardly of the mouth of laterally open groove 30 and near the reverse bend 38 of first edge structure 26.

The opposite edge structure 28 shown in the tension locking building panel 20 of FIG. 1 includes substantially laterally extending legs, 40 and 42, having a reverse bend 41 therebetween to form a groove 43 laterally open inwardly such that when panel 20 is assembled with other like panels, leg 42 of second edge 28 is received within laterally open groove 30 of first edge 26 to form a tension joint further described below.

Preferably, the extent (cross-sectional height) of edges 26 and 28 are on the order of ¼ inch (6.4 mm.) or less and is shown by dimension "A" in FIG. 1, with preferably "A" being the same for edges 26 and 28 in a tension locking panel. The extent is measured normal or perpendicular to the general plane of panel 20, and it is that dimension which is basically determinative of the nesting height of building panels of the present invention. Normally, the smallest extent or cross-sectional height of the edge structure depends upon fabrication limitations in making the building panels. Such fabrication limitations may be a result of the metal alloys used, the gauge and temper of the alloys, and the fabricating equipment, among other factors. Preferably, the maximum extent of the edge structure is no more than 25% of the channel extent (depth), measured in the same direction, and, preferably, the extent of the channel is at least 1 inch (254 mm.).

As shown in FIG. 1, near the base of wall 24 of panel 20, preferably a step area 44 is interposed between diverging wall 24, and first edge structure 26 with laterally open groove 30 therein. Step area 44 has two planar portions, preferably section 48 parallel to the general plane of panel 20, and diverging wall section 46. Wall 46 must be diverging in order to permit the desired nesting of channels 22 of stacked panels 20 when the extent of step 44, dimension "D", is greater than dimension "A". Of course, if step 44 has a smaller extent than the edges, then walls 46 need not be diverging. Preferably, wall 46 diverges 10 to 20 degrees, as shown by angle $\beta$, from the vertical to provide a contact surface during stacking. Similarly, as for the angle of the diverging sidewalls 24 of channel 22, angle $\beta$ must be greater than zero, and should be at least 10 degrees. An optimum angle $\beta$ may be calculated in the same manner as optimum angle $\beta$. Step area 44, though not essential to the practice of the present invention, does provide additional bearing areas to reduce packing stresses during nestable stacking.

FIG. 1 also illustrates other preferred features of building panels of the present invention to facilitate nesting of the panels. A reference line is shown indicating that leg 42 of edge structure 28, leg 34 of edge structure 26 and point "B" on building panel 20 at the base of diverging sidewalls 24 of channel 22 lie in substantially the same plane, i.e. the general plane of the panel. Preferably, point "B" on the face of panel 20 should not be above and should not be more than ⅛ inch (3.2 mm.) below the reference line when panel 20 is in the free-standing, i.e. unstacked and unassembled, position. Having point "B" lying in and about the same plane is not necessary, however, for nestability when panels 20 are the same. As FIG. 1 shows a tension-locking panel 20, the compression locking panel of the present invention (of FIGS. 8 to 11) similarly has leg 34′ of edge structure 26′, point "B" and leg 40′ of second edge structure 28′ lying in planes substantially parallel to the general plane of panel 20.

As shown in FIG. 1, a dimension "C" of step 44 may be measured substantially parallel to the general plane of panel 20 and, preferably, is equal to the similar dimension of second edge structure 28 for a tension locking panel. For a compression locking panel, the exposed leg portion of edge structure 26′, preferably, is equal to dimension "C". Dimension "C" in that way contributes to the aesthetic symmetry of panels 20 in an assembled condition on a wall structure. Similarly, the extent of step 44, dimension "D", measured perpendicular to the general plane of panel 20, should be slightly greater than similar dimension "A" for the edge structures.

Figure 5:
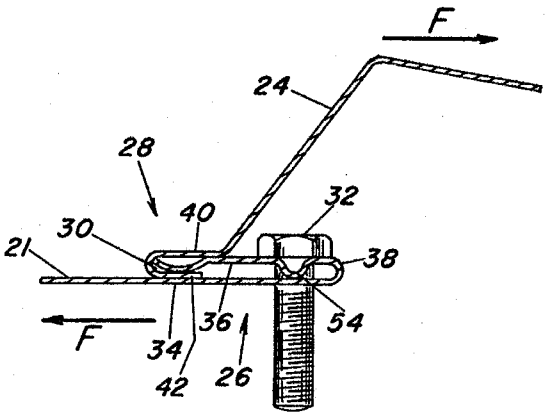
FIGS. 5 to 7 are cross-sectional views of joints formed by adjacent panels of the present invention engaged in tension.
Figure 7:
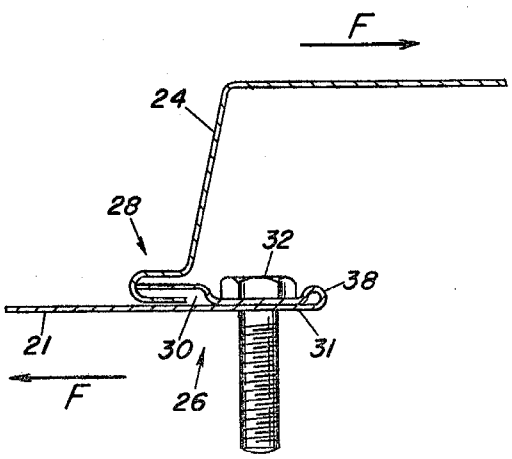

FIGS. 5 and 7 illustrate tension locking joints formed by cooperating edge structures 26 and 28 of adjacent panels 20. In tension joints, the forces, indicated by "F", at the edge structures of each adjacent panel act in opposite directions as if to pull the adjacent panels away from each other. In FIG. 5, leg 42 of second edge structure 28 is in place in groove 30 which is laterally open inwardly. Edge structures 26 and 28 cooperate such that leg 36 of edge 26 is substantially coextensive with leg 40 of edge structure 28. Similarly, leg 34 of edge structure 26 is substantially coextensive with leg 42 of edge structure 28. In the tension locking joint of adjacent building panels 20 shown in FIG. 5, fastener 32, which may be a nail or self-tapping screw, secures building panel 20 to a building structure by the fastening edge portion of edge 26 near reverse bend 38. The fastener is laterally outward of the open mouth of groove 30, underlies a section of the body portion 21 of an adjacent panel 20, specifically, a portion of wall 24 of the adjacent building panel 20 near the opposite lateral edge structure 28 and is concealed from the exposed face of the building panels in the assembled condition.

Figure 6:
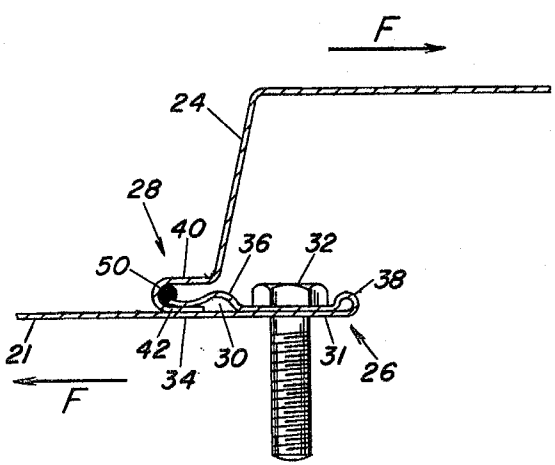

FIG. 6 shows a cross-sectional view of an alternative configuration for a tension locking joint of the present invention. First edge structure 26 having a reverse bend 38 and a groove laterally open inwardly for receiving leg 42 of the opposite second edge structure 28 of an adjacent panel is shown having a slightly different configuration. FIG. 6 further shows that a gasket or sealant bead 50 may be located in place between legs 40 and 42 of edge structure 28 such that in a tension joint, leg 36 of edge 26 contacts gasket 50 to provide a weather-tight seal. Preferably, gasket 50 is of a foamed material and in an elongated form, such as a rope, for easy installation. Gasket 50 may be used with all of the panels of the present invention and in any of the tension and compression joints of the present invention.

FIG. 7 further shows another alternative configuration of edge structure 26 in tension locking engagement with an adjacent panel. For all the tension locking joints that fall within the scope of the present invention, fastening edge portion 31 and fastener 32 are located on first edge structure 26 having a reverse bend 38 therein, and laterally outwardly of the mouth of groove 30 which is laterally open inwardly.

Figure 8:
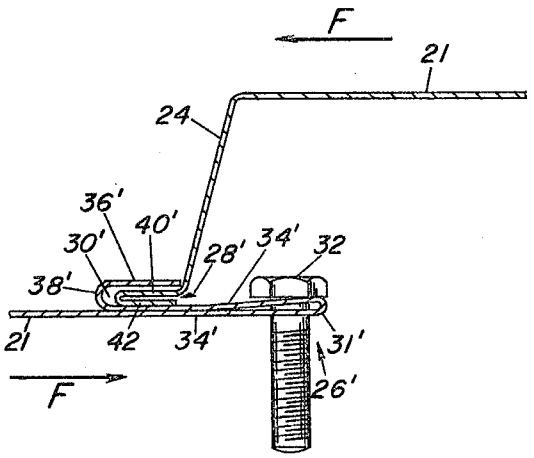

FIGS. 8 to 11 illustrate cross-sectional views of adjacent building panels 20 of the present invention locked in compression joints. In FIG. 8, first edge structure 26′ has a groove 30′ laterally outwardly open and formed by a reverse bend 38′ between legs 34′ and 36′. Second edge structure 28′ having legs 40′ and 42′ is located within groove 30′ of edge 26′ to form a compression joint. By compression joint, it is meant that the forces "F" at the edge structures of adjacent panels 20 act toward each other to press the adjacent panels 20 together at the joint. Fastening edge portion 31' of first edge 26' is laterally outward of the open mouth of groove 30' and, preferably, laterally outward of reverse bend 38'.

Figure 9:
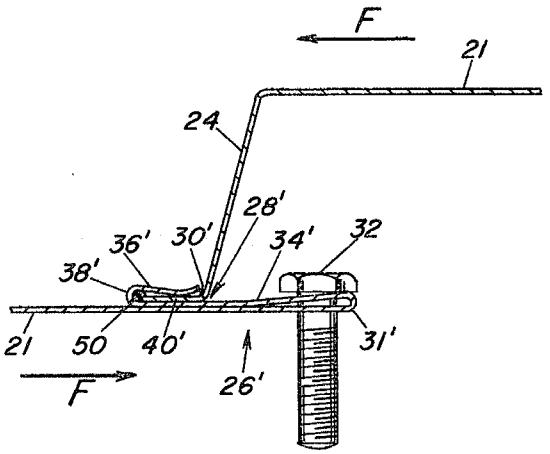
FIGS. 8 to 11 are cross-sectional views of joints formed by adjacent panels of the present invention engaged in compression.
Figure 10:
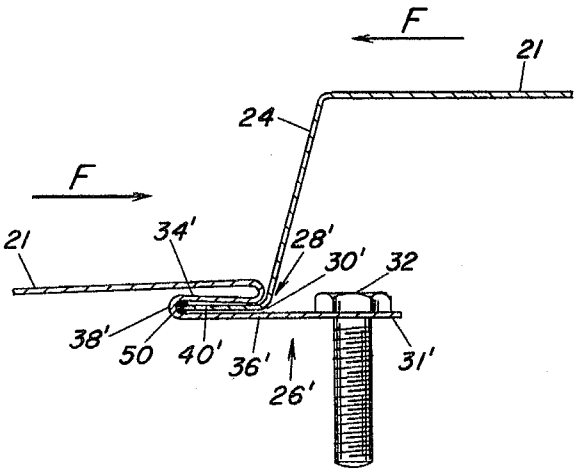

FIGS. 9 and 10 show alternative configurations of the compression joint where second edge structure 28' includes only one leg portion, leg 40', extending substantially laterally from the body portion 21 of panel 20 at the base of sidewall 24 of channel 22 and lying in a plane parallel to the general plane of panel 20. On first edge 26', groove 30' laterally open outwardly receives leg 40' of edge 28' between legs 36' and 34' of first edge 26. A gasket 50 may be in place at reverse bend 38' between legs 36' and 34' of edge structure 26' to form a weather-tight seal in the compression joint.

Figure 11:
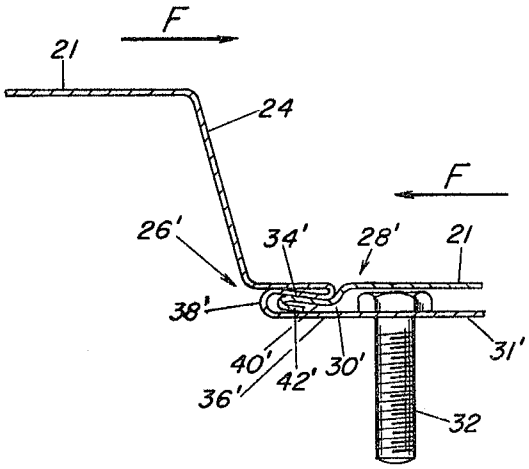

FIG. 11 illustrates a cross-sectional view of an alternative configuration of a compression joint where second edge structure 28' includes legs 40' and 42' extending substantially laterally from body portion 21 of panel 20 and lying in a plane parallel to the general plane of panel 20. First edge structure 26' is at the base of sidewall 24 of channel 22 projecting laterally outwardly from the channel mouth. Groove 30', formed by legs 34' and 36' of first edge structure 26', opens laterally outwardly and receives both legs 40' and 42' of second edge structure 28'.

In each of the FIGS. 8 to 11, fastening portion 31' and fastener 32 are outward of laterally open groove 30. In an assembled condition, the compression joints shown in FIGS. 8 to 11, fastener 32 is located on edge structure 26 near its periphery and underlies the body portion 21 of the adjacent panel 20 near the opposite edge structure 28. Such assembly conceals the fastener from the exposed face of the building panels.

Though not shown in FIGS. 8 to 11, building panel 20 having compression locking joints may also include a step 44 with a planar section 48 and a diverging sidewall 46 to provide an additional bearing area as was discussed in relation to the tension locking panel of FIG. 1.

As shown and described in exemplary embodiments in FIGS. 5 to 11, a joint formed by engaging edge structures conceals a fastening means such that the fastening means underlies a portion of the adjacent panel near its opposite edge. Such a portion of the adjacent panel may include the edge structure, the channel or the panel body.

Figure 12:
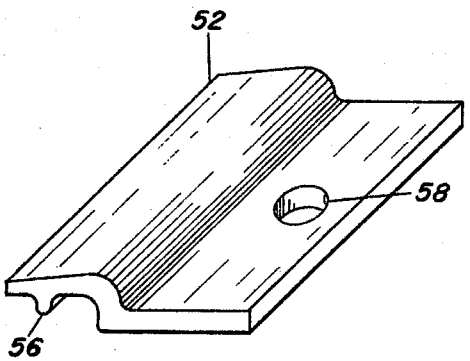
FIG. 12 is a partial perspective view of an alternative embodiment of a fastening means.

FIG. 12 illustrates an alternative embodiment for a fastening means. Fastener clip 52 has a longitudinally downwardly extending rib 56 for engagement within longitudinal groove 54, as shown in FIG. 1, of fastening edge portion 31 on the first edge structure 26, having a laterally open groove therein. Hole 58 is provided in clip 52 for securing the clip by fasteners, such as a screw or nail to a building structure. Use of clip 52 obviates any need to provide holes in panels 20 for attachment to buildings. The alternative fastener clip 52 can be used for both the tension locking and compression locking joints. Reference to FIG. 5 further shows that fasteners other than those like clip 52 can be used to secure the panel 20 at edge structure 26 when longitudinal groove 54 is present.

Figure 13:
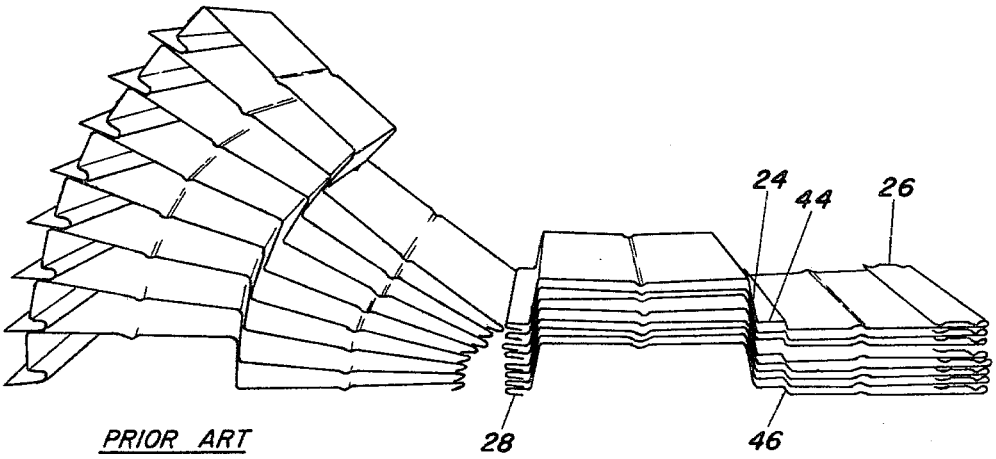
PRIOR ART FIG. 13
FIG. 13 is a cross-sectional view of a vertical stack of nested building panels of the present invention and a stack of prior art building panels.

FIG. 13 illustrates a cross-sectional view of a vertical stack of building panels 20 of FIG. 3, nested in a preferred manner with the edge structures 26 and 28, adjacent the identical structure on an adjacent panel 20 in a vertical stack. The diverging sidewalls 24 of channel 22 and the diverging sidewall 46 of step 44 of each building panel 20 nest exactly with the distance between non-contacting parts of the panels equal or about equal to the larger dimension "A" of edge structures 26 and 28. The angles of walls 24 of channels 22 and bearing areas are designed as to minimize marking due to localized packing stresses on the exposed surfaces of the panels in a vertical stack. Stacked panels 20 contact adjacent panels at the edge structures 26 and 28 and at the diverging walls 24. Marking of the surface is limited due to the generally planar contacting surfaces. Generally, any marking is confined to the unexposed face of panel 20 or to areas concealed when the panels are assembled on a building structure, such as parts of the edge structures 26 and 28. When panel 20 includes step area 44, as shown in FIG. 13, additional contact is made by diverging walls 46 of respective adjacent panels 20. The added contact surfaces reduce the overall stress per unit area of a stacked panel and thus further reduce the likelihood of marking.

FIG. 13 also illustrates a stack of prior art panels stacked in a manner similar to the building panels 20 of the present invention, i.e. with edge structures adjacent the identical structure on an adjacent panel in the stack. The prior art panels do not exhibit a stable vertical stack of panels that can facilitate shipment and storage.

Figure 14:
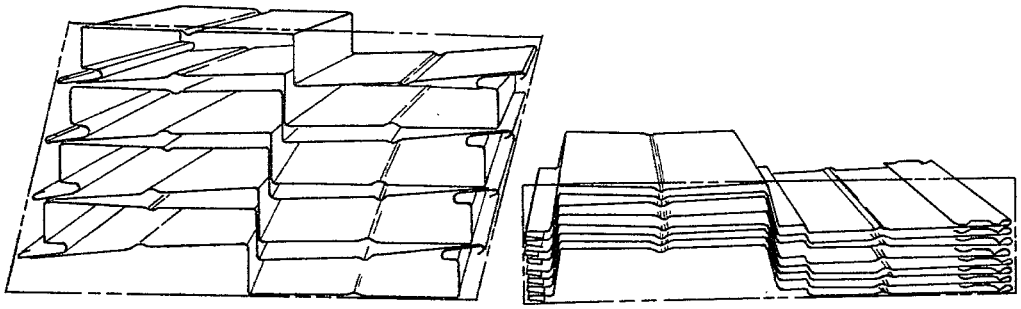
PRIOR ART FIG. 14
FIG. 14 is a cross-sectional view of a vertical stack of nested building panels of the present invention and a stack of prior art building panels alternately inverted.

In FIG. 14, the nested stack of building panels 20 of FIGS. 3 and 13 are shown next to a stack of prior art panels exhibiting a small degree of nestability. The prior art panels are alternately inverted during stacking. A comparison of the two stacks of equal numbers of panels illustrates the improved nestability of the building panels of the present invention.

As an example to further illustrate such improved stacking with a relatively short stack height, the area defined by dotted lines for each stack of panels in FIG. 14 is useful to calculate nestability of a building panel from the following formula:

$$(A_{metal})/(A_{occ.}) \times 100 = \text{percent nestability}$$

where $A_{metal}$ is the area of cross-sectional metal of panels; and $A_{occ.}$ is the area occupied by panels, equal to the width of the panels multiplied by the stack height of panels.

For contoured building panels of the present invention, the nestability in a vertical stack is on the order of greater than 19%, which is an improvement over prior art panels which may stack with nestability on the order of less than 5%. Though the actual calculated nestability figure depends on the actual configuration of the building panel of the present invention, the illustrated panels in FIG. 14 show a marked improvement in nesting with a relatively small stack height.

In accordance with this invention, a building wall panel 20 is provided having improved nestability for shipment, handling and storage and which can be easily assembled to a wall structure to provide a concealed fastener under an aesthetically contoured panel. Although a preferred embodiment and several alternative embodiments of a building panel of this invention have been illustrated and described, it will be apparent to those skilled in the art that changes can be made therein without departing from the scope of the invention.

What is claimed is:

1. A contoured building panel adapted to be secured to a building structure by concealed fasteners, said panel having faces for exposed and concealed disposition on a building structure and having improved nestability with other like panels in a vertical stack for storage and shipment with a relatively short stack height, comprising:

(a) a body portion including at least one longitudinally extending channel therein having opposed sidewalls substantially continuously diverging from the bottom of the channel to the mouth of the channel to permit nesting of the channels of stacked panels, each of said diverging sidewalls defining an angle of 5° to 80° measured between said sidewall and a plane passing through the sidewall near the mouth of the channel and normal to the general plane of said panel;

(b) lateral edge structures along opposite sides of said body portion for engagement with an opposite edge structure of an adjacent panel;

each of said edge structures projecting outwardly substantially laterally from the mouth of the channel in said body portion, having leg portions substantially lying in a plane parallel to the general plane of said panel with no portion of each of said edge structures projecting inwardly beyond the periphery of its respective side of said body portion, and having a maximum extent measured perpendicular to the general plane of said panel no more than 25% of the extent of the channel measured in the same direction, the perpendicular extent being determinative of the nesting height of stacked panels;

at least one of said edge structures having a reverse bend therein forming a groove open laterally inward of said panel for receiving at least a portion of the opposite edge structure of an adjacent panel for engaging said panels in a tension joint;

(c) a fastening edge portion on the edge structure which has said reverse bend therein and disposed laterally outwardly of the open mouth of said groove and adapted to receive fastening means to secure said panel to a building structure with the fastening means underlying said body portion of the adjacent panel for concealing the fastening means; and (d) the angle of the diverging sidewalls of the channel being a function of the maximum perpendicular extent of said edge structures so that said like panels when vertically stacked contact adjacent panels along the leg portions of said edge structures and along said diverging sidewalls of said channel for increasing support surfaces of nested panels.

* * * * *